United States Patent [19]

Correale

[11] 4,363,140

[45] Dec. 14, 1982

[54] FOOTBALL HELMET FACE GUARD

[76] Inventor: James V. Correale, 4202 Lake Grove Dr., Seabrook, Tex. 77586

[21] Appl. No.: 287,251

[22] Filed: Jul. 27, 1981

[51] Int. Cl.[3] ..... A63B 71/10

[52] U.S. Cl. ..... 2/9; 2/424

[58] Field of Search ..... 2/9, 424, 425, 410, 2/10

[56] References Cited

U.S. PATENT DOCUMENTS

| | | | |
|---|---|---|---|
| 2,986,739 | 6/1961 | Rozzi, Sr. | 2/9 |
| 3,139,624 | 7/1964 | Humphrey | 2/9 |
| 3,263,236 | 8/1966 | Humphrey | 2/9 |
| 3,608,089 | 9/1971 | Abbatelli | 2/9 |
| 3,889,296 | 6/1975 | Martin | 2/9 |
| 4,086,664 | 5/1978 | Humphrey et al. | 2/9 |
| 4,233,687 | 11/1980 | Lancellotti | 2/9 |
| 4,271,537 | 6/1981 | Bowlus et al. | 2/9 X |

*Primary Examiner*—Peter P. Nerbun

*Attorney, Agent, or Firm*—Russell H. Schlattman

[57] ABSTRACT

A grid-type face guard is attached to a football helmet by means of forehead spring clips and side spring clips. Forehead spring clips include means for preventing any downward movement of face guard in the event of a blow toward face guard. With this construction, the face guard will detach by a slight pull in any direction away from face guard yet not detach as a result of a blow toward the face guard. Injuries resulting from face masking are prevented.

5 Claims, 6 Drawing Figures

FOOTBALL HELMET FACE GUARD

BACKGROUND OF THE INVENTION

This invention is concerned with the helmet and its associated face guard normally worn by football players. More specifically, this invention is concerned with a football helmet and a grid-type face guard which is attached to the helmet in a unique and novel manner which permits an immediate detachment or break away of the face guard from the helmet with a slight pull on the face guard in any direction away from the helmet.

Football helmet face guards are available in a variety of configurations. The most common face guard is a grid-type fabricated from steel rods or bars approximately one fourth inch (0.6 cm) in diameter. Horizontally and vertically positioned bars are welded together to form a unitary grid-like structure. The rods are then covered with a rubber-like material. The face guard is usually bolted to the forehead and each side of the helmet.

The obvious purpose of such a face guard is to protect the face of the wearer, particularly his eyes, nose, and mouth, without unduly restricting his vision during play. While such face guards do in fact serve their intended purpose, they introduce another hazard which, in the view of many, is of very serious concern, particularly where younger athletes are concerned.

Football is a heavy contact sport. In the heat of battle, all too often the face guard presents a convenient handle or lever to assist in bringing down the ball carrier. While "face masking" is prohibited, it does never the less occur with alarming frequency. Most of the time its occurrence is accidental. At times it simply cannot be avoided.

Unfortunately, face masking can cause serious injury to the neck, back and spinal cord of the player to which it is applied. All too frequently such injuries are more serious and permanent than those injuries to the face that caused the masks to be initially adopted. The problem is serious for anyone playing the game, whether he be a professional athlete or a young grade school boy. It is particularly serious among the younger players. Professional athletes are superbly conditioned athletes, better able to resist injury from face masking. Younger players lack the skill and muscle development to resist without injury a violent face masking.

A number of attempts have been made in the past to correct this situation by providing a face guard that would detach itself from the helmet in the event of face masking. None of the prior art devices have totally solved the problem. All suffer from one or more deficiencies that prevent their acceptability. A number of prior art detachable face guards suffered from the deficiency of being knocked off by a blow toward the face guard, particularly by a blow to the lower region of the grid-type face guard. Such a face guard could become detached through normal scrimmage contact or a fall to the ground when tackled, eliminating all face protection under conditions when it was really needed. Other prior art devices required much too strong a pull to detach the face guard thereby affording little or no protection against face masking. Other face guards of the prior art could be detached only by a pull in one direction, namely, in a direction perpendicular to and away from the center of the face of the wearer. A pull from any other angle would not detach the face guard.

It is a principal object of the present invention to provide a unique and novel means for attaching a face guard to a football helmet.

A particular object of this invention is to provide a football helmet with a face guard fastened to said helmet in such a manner that the face guard can be detached by a simple slight pull on the face guard in any direction away from the helmet and yet not be detached by any blow or impact in a direction toward the face guard.

Other objects will become apparent from the description of the invention which follows.

SUMMARY OF THE INVENTION

According to the instant invention, a grid-type face guard is attached to a football helmet by means of spring steel clips. One such clip is fastened to the outside of each side of the helmet and positioned to clasp and hold a vertical side bar of the face guard. At least one, and preferably two, such spring steel clips are fastened to the outside of the forehead of the helmet and positioned to clasp and hold the horizontal bar of the face guard extending across the lower part of the helmet covering the forehead. The forehead spring clips include means for substantially preventing any downward movement of the clasped horizontal bar responsive to a blow or force applied to the faceguard in a direction toward the face guard. The selected strength of the spring steel clips is such that the face guard is rigidly and firmly held in place yet is readily detachable with a slight pull on the face guard.

An important feature of this invention is that a blow to the lower region of the grid-type face guard will not detach the face guard. With the side clips actually providing a pivot around which the face guard would tend to turn in the event of such a blow, it was indeed surprising that detachment could be prevented in such an event by merely providing a means for preventing any downward movement of the face guard bar clasped in the forehead fasteners and at the same time still permit detachment of the face guard by a slight omni-directional pull on the face guard.

DESCRIPTION OF THE PREFERRED EMBODIMENT OF THIS INVENTION

Figure 1:
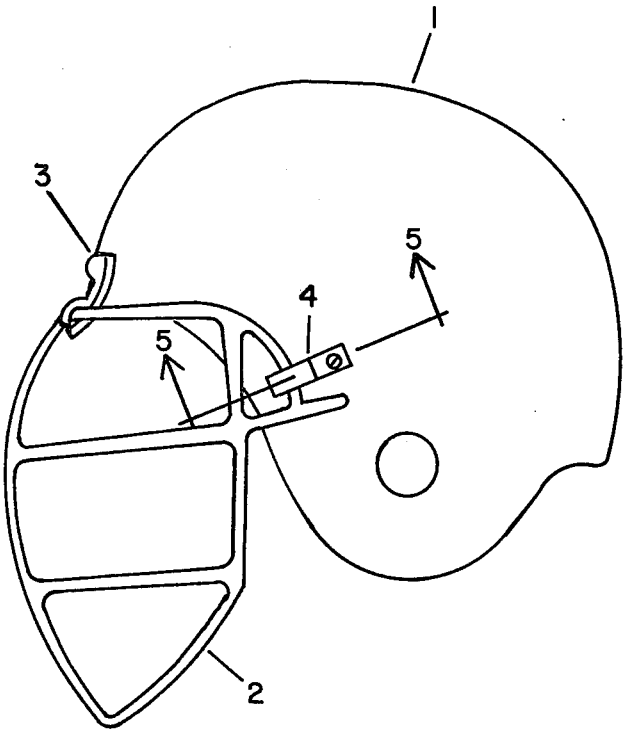
FIG. 1 is a side view of a football helmet with a conventional grid-type face guard attached thereto in accordance with this invention.
Figure 2:
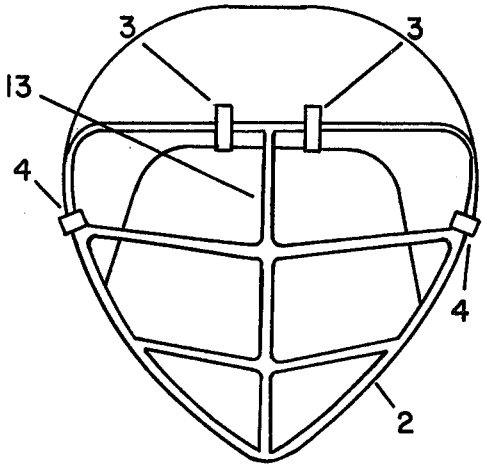
FIG. 2 is a front view of the football helmet and face guard showing the general position of the clips by which the face guard is attached to the helmet.

Referring to FIGS. 1 and 2, a conventional football helmet is shown at 1 with a grid type face guard 2 firmly but removeably attached to the helmet by means of forehead attachments 3 and side attachements 4.

Figure 3:
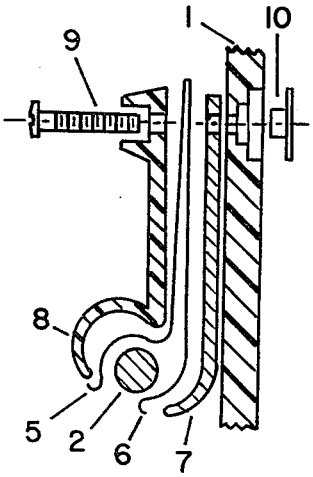
FIG. 3 is a side view of the forehead clips enlarged and exploded to show the detail of construction and assembly of this clip in accordance with one embodiment of this invention.

Considering first the forehead attachment 3 as shown in FIG. 3, the attachment includes a conventional spring steel clip having an outer leaf 5 and an inner (helmet side) leaf 6 formed to clasp and hold the horizontal bar of the face guard 2 extending across the lower part of the helmet covering the forehead. The leafs of the spring steel clip are formed to conform to the shape and size of the horizontal bar, permitting the bar to be snapped into the clip and firmly held but capable of release with a moderate pull on the face guard. Element 7 is a rigid inflexible metal strip, such as $\frac{1}{8}''$ stainless steel, positioned between inside leaf 6 and helmet 1. Aluminum can also be used for element 7. The bottom portion of element 7 is curved to conform to the general shape of the horizontal bar of the face guard, with the curved portion extending sufficiently around the bottom of the bar to prevent any substantial downward movement of the bar. With this construction only leaf 5 moves to accomodate the insertion or removal of the horizontal bar of the face guard. Element 8 is a molded strip of plastic of a width sufficient to cover the spring clip as a safety feature to avoid injuries from contact with the rather sharp edges of the clip. The strip of plastic should have sufficient flexibility to permit it to flex with the movement of leaf 5 without breaking. Polymers of rubber modified polystyrene and terpolymers of acrylonitrile-butadiene-styrene are particularly suitable. The entire assembly is attached to the forehead of the helmet by means of bolt 9 and nut 10, the latter preferably being counter sunk into the helmet to avoid any possible contact with the forehead of the wearer.

Figure 4:
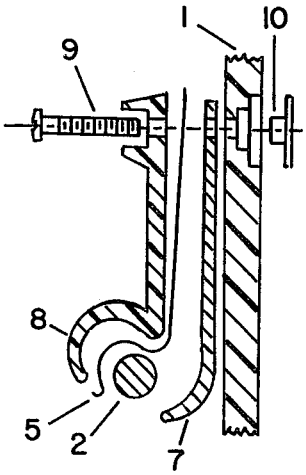
FIG. 4 is similar to FIG. 3 showing the forehead clip in accordance with the preferred embodiment of this invention.

FIG. 4 shows a modification of the previously described forehead fastener, this modification constituting the preferred embodiment of this invention. The elements of FIG. 4 are identical to FIG. 3 with the exception that inner leaf 6 has been eliminated. In this embodiment the fastener consists of the single spring steel outer leaf 5 coacting with the rigid metal strip 7 to form the spring clip. Again, when inserting or removing the metal bar of the face guard, only the outer leaf 5 moves in response thereto. As in the case shown in FIG. 3, the bottom portion of element 7 is curved to conform to the general shape of the metal bar of the face guard, with the curved portion extending sufficiently around the bottom of the metal bar of the face guard to prevent any substantial downward movement of the metal bar. Plastic element 8, bolt 9, and nut 10 are the same as in FIG. 3.

Figure 5:
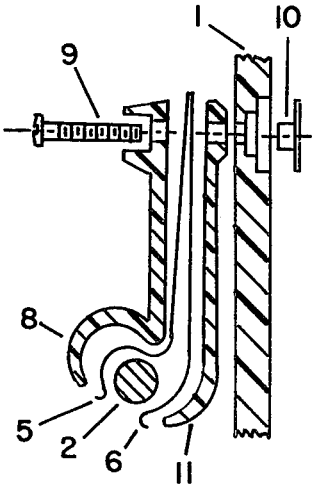
FIG. 5 is a cross section of the side clip taken on line 5—5 in FIG. 1 enlarged and exploded to show the detail of construction and assembly of this clip.

The side fasteners used in this invention, as shown in FIG. 5 consist of a spring steel clip similar to that of FIG. 3 having an outer leaf 5 and an inner leaf 6 formed to conform to, clasp and hold a vertical side bar of the face guard. In the case of these side fasteners, there is no need to restrict the free movement of inner leaf 6. Consequently, the side fasteners do not require the rigid metal strip 7 included in the forehead fasteners. Plastic protective cover 8, similar to that shown in FIG. 3, can also be provided. Element 11 is another plastic protective cover positioned between the fastener and the helmet to provide cover for the end portions of the spring clip. The fastener assembly is connected to the helmet with bolt 9 and counter sunk nut 10 as in the case of the forehead fasteners shown in FIGS. 3 and 4.

The plastic elements 8 and 11 do not constitute a substantive aspect of the instant invention. These elements represent a rather obvious safety expedient to avoid any injury from contact with the metal spring clips.

Figure 6:
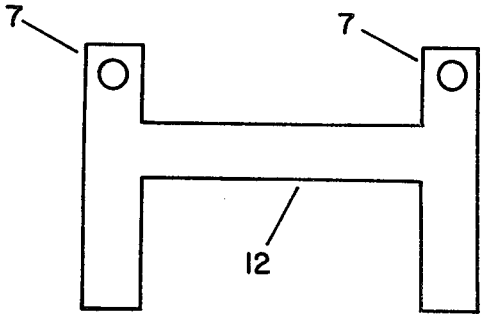
FIG. 6 is a front view showing the rigid inflexible metal strips of each of the two forehead clips rigidly joined together with a metal strip.

FIG. 2 illustrates the use of two forehead fasteners 3, equally placed on either side of center. The use of two such fasteners improves stability in attachment of the face guard. Additional stability is accomplished by rigidly joining elements 7 of both forehead fasteners. This can be accomplished by providing a metal connecting element 12 as shown in FIG. 6. With such an assembly maintaining alignments of elements 7 is facilitated. This construction prevents any swiveling or turning of elements 7 and maintains the inner strip of rigid metal of each forehead clip in a spaced apart fixed relationship to each other.

The face guard shown in FIGS. 1 and 2, depicts a vertical bar 13 extending from the bottom of the face guard to the center of the forehead. In some face guards, this vertical bar extends from the bottom of the face guard to, and terminates at, a horizontal bar below the forehead. In such instances, a single centered forehead fastener may be used. Thus, in its broadest aspect, this invention contemplates the use of at least one forehead fastener, with two being preferred for improved stability in any case.

In actual practice, an operable fastener assembly has been found to measure approximately one-half inch (1.3 cm) wide and two inches (5.1 cm) long although the precise measurement is not to be deemed a limitation in this invention. The size and firmness of hold incorporated into the spring clip will vary with the degree of anticipated forces to which the face guard will be subjected and the degree of protection to be afforded the wearer. A face guard more readily releasable would be preferred for small boys playing football than in the case of the heavier and stronger professional athletes.

An important feature of the present invention is that it can be used on existing football helmets and face guards. All that is required is replacing presently used fasteners with those described herein. Furthermore, while the invention has been particularly described in connection with football helmets, the invention is equally applicable to helmets and associated face guards employed in other sports and occupations.

What is claimed is:

1. In combination, a football helmet and the like, a grid-type face guard therefor, leaf spring steel side clips attached to the outside of each side of said helmet, said side clips each positioned and formed to clasp a vertical bar of the face guard when in its protective position, at least one forehead clip attached to the outside of the forehead portion of said helmet, said forehead clip comprising (a) a spring clip formed from an outer and inner leaf of spring steel, said spring clip positioned and formed to clasp the horizontal bar of the face guard extending across the lower portion of the helmet protecting the forehead, and (b) a strip of rigid metal positioned between the spring clip and the helmet, said strip of rigid metal being conformed to prevent any substantial downward movement of said horizontal bar of the face guard in response to a force applied to and toward the face guard, all of said clips formed to hold the face guard firmly in its protective position and release it from the helmet in response to a pull on the face guard and away from the helmet.

2. The combination of claim 1 wherein two forehead clips are employed.

3. The combination of claim 2 wherein each forehead clip comprises an outer leaf of spring steel and inner strip of rigid metal, both conformed to coact to clasp the horizontal bar of the face guard and the strip of rigid metal further conformed to prevent any substantial downward movement of said horizontal bar.

4. The combination of claim 2 wherein each forehead clip comprises an outer leaf of spring steel conformed to clasp the horizontal bar of the face guard and an inner strip of rigid metal conformed to coact with the outer leaf to clasp the horizontal bar of the face guard and also conformed to extend sufficiently around the bottom of the horizontal bar to prevent any substantial downward movement of said horizontal bar with respect to the helmet in response to any blow to and toward the face guard.

5. The combination of claims 3 or 4 wherein the inner strip of rigid metal of each of the forehead clips are rigidly joined together to maintain them in a spaced apart fixed relationship to each other.

* * * * *